US008696522B2

(12) United States Patent
Brady

(10) Patent No.: US 8,696,522 B2
(45) Date of Patent: Apr. 15, 2014

(54) TARPAULIN SURFING APPARATUS AND METHOD

(76) Inventor: Robert Brady, San Juan Capistrano, CA (US)

( * ) Notice: Subject to any disclaimer, the term of this patent is extended or adjusted under 35 U.S.C. 154(b) by 340 days.

(21) Appl. No.: 12/978,561

(22) Filed: Dec. 25, 2010

(65) Prior Publication Data

US 2012/0040801 A1 Feb. 16, 2012

Related U.S. Application Data

(60) Provisional application No. 61/401,435, filed on Aug. 13, 2010.

(51) Int. Cl.
*A63B 21/00* (2006.01)

(52) U.S. Cl.
USPC ..... 482/51; 482/71

(58) Field of Classification Search
USPC ..... 482/51, 71; 472/88–91
See application file for complete search history.

(56) References Cited

U.S. PATENT DOCUMENTS

| | | | | |
|---|---|---|---|---|
| 5,352,165 | A * | 10/1994 | Koblick | 482/51 |
| 6,350,174 | B1 * | 2/2002 | Halford et al. | 446/444 |
| 6,368,253 | B1 * | 4/2002 | Harrigan | 482/70 |
| 6,554,748 | B2 * | 4/2003 | Tollner | 482/51 |
| 7,547,255 | B2 * | 6/2009 | Lochtefeld | 472/90 |

* cited by examiner

*Primary Examiner* — Jerome W Donnelly
(74) *Attorney, Agent, or Firm* — Steven W. Webb

(57) ABSTRACT

A new method of simulating the experience of surfing the tube of a wave is presented, consisting of a tarpaulin with weights and a handle on one corner. The tarpaulin is pulled up in the air and forward creating a tube shaped form within which a skateboarder can be propelled as if he was surfing a wave.

1 Claim, 2 Drawing Sheets

TARPAULIN SURFING APPARATUS AND METHOD

RELATED APPLICATIONS

This application claims the benefit of Provisional Application 61/401,435, filed on Aug. 13, 2010, and that application is included here by reference.

FIELD OF THE INVENTION

The present invention relates to the field of skateboard games and skateboard athletic competitions.

BACKGROUND OF THE INVENTION

Skateboard riding is an established athletic endeavor and has many variations, including competitive skateboarding on curved surfaces, jumping, and the like. There are many skateboard designs and configurations, and many established skateboarding surfaces to play and compete on.

Tarpaulin surfing is a new form of skateboarding where the experience of riding a surfboard inside "the tube" of a wave is reproduced for the enjoyment of the rider. Though not strictly designed for competition, tarpaulin surfing could be practiced in a competitive mode.

SUMMARY OF THE INVENTION

Tarpaulin Surfing is a sport or game which uses a large piece of flexible material to simulate the motion of a wave around a surfboard. This game or sport also uses a vehicle which can be but is not limited to a skateboard. Corner weights are used to hold the tarpaulin in place as it is maneuvered over the skateboard rider.

There are a small group of players or participants. The action of the game or sport is where one or more persons holds one or more corners of the tarp while standing on the tarp and pulls the fabric forward holding the corner up in the air, causing the tarp to overlap itself without first touching itself. This creates a wave type form in the tarp with a space between the person pulling the corner and the remaining tarp in which the rider (skateboarder or runner or player on any type vehicle) can go between and as the person(s) holding the corner(s) move, the wave form moves as well and resembles that of a wave breaking with a large tube.

The sensation is very much like that of tube riding in surfing, in which the surfer rides under the curl of the wave. The riders can either push themselves along or be pushed by the moving tarp. As the tube travels, the rider travels as well usually finishing the ride by coming out of the tube.

DETAILED DESCRIPTION

Figure 1:
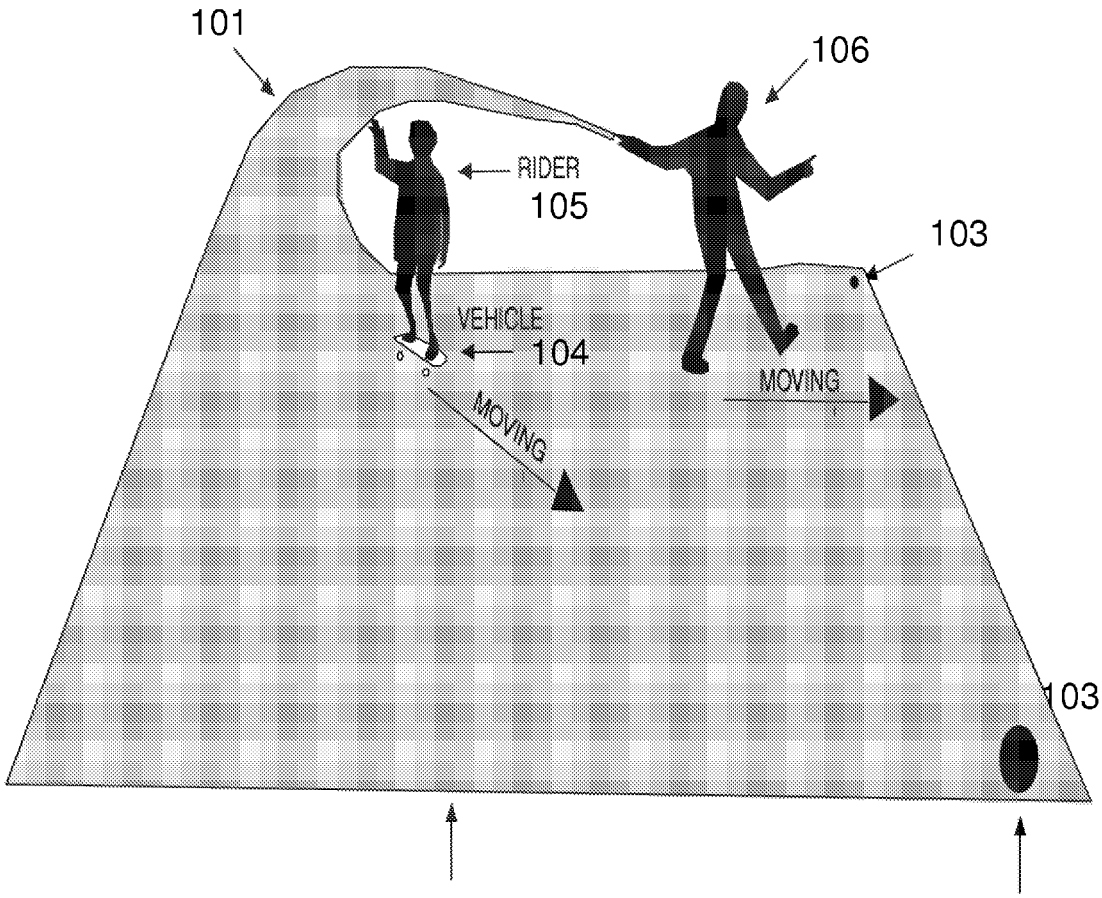
FIG. 1. Overview of tarpaulin surfing
FIG. 2. Optional handle
Figure 2:
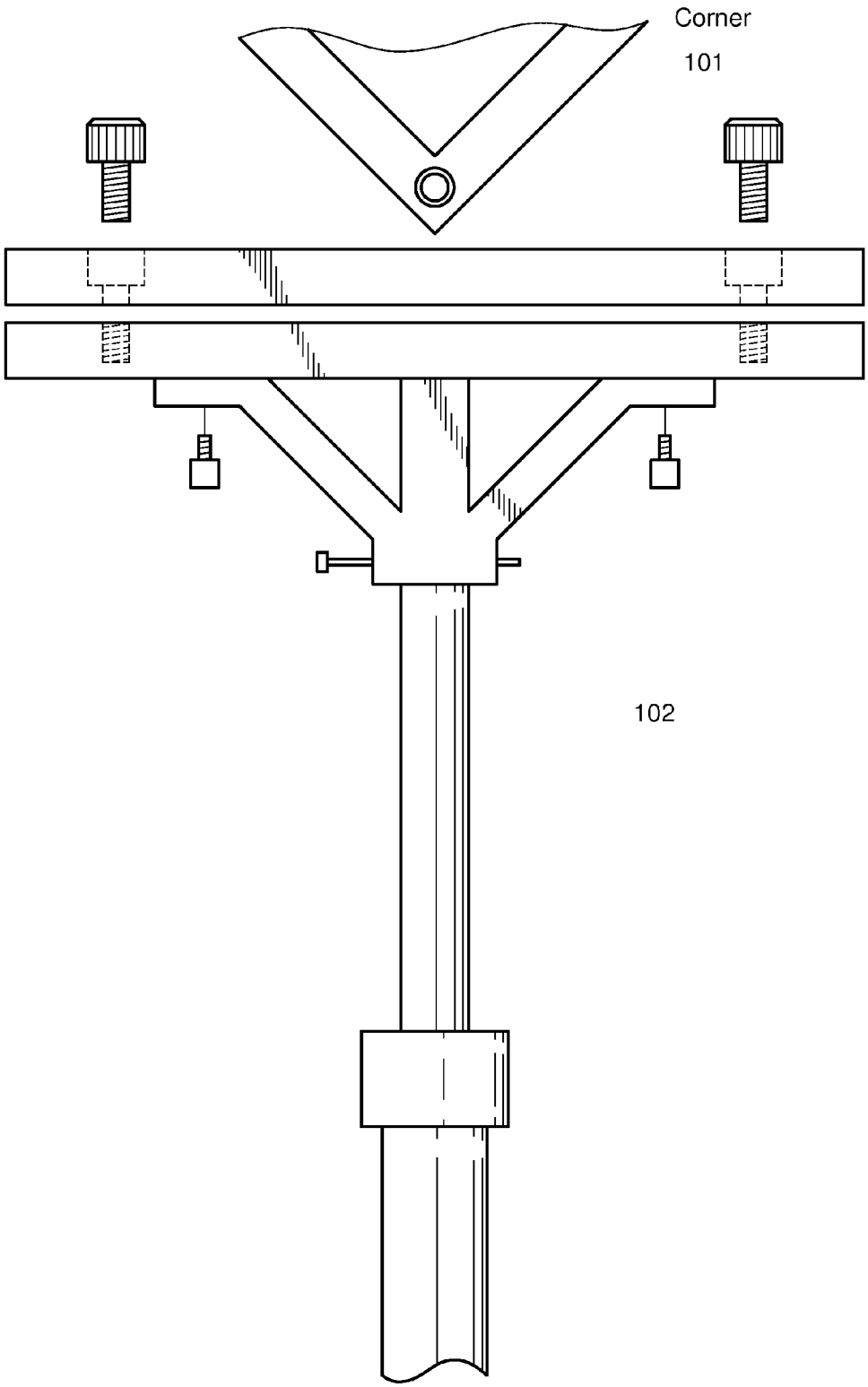

As in FIG. 1, the components of the tarpaulin surfing system are a piece of flexible material 101, an optional handle

102, a plurality of weights 103, a vehicle 104 and a rider 105. A tarpaulin puller 106 is also necessary to create the tube action of the game.

The curled tarpaulin tube 107 is created by a coordinated pulling of one corner of the tarpaulin 101 with the optional handle 102. The size of the flexible material 101 is not fixed, but can be several feet in each direction. The shape of the flexible material 101 is rectangular in the preferred embodiment and the material can be made of several different fabrics including but not limited to canvas, carpet, foam, vinyl, thin plastic, heavy cotton, nylon, and polyester. The vehicle 104 can be but is not limited to a skateboard.

There are a small group of players or participants, a minimum of two. The method of the sport is one or more persons holding one or more corners of the flexible material 101 while standing on the flexible material 101 pulling the flexible material 101 forward by holding the corner with the optional handle 102. The captured air under the corner causes the flexible material 101 to overlap itself without first touching itself, creating a wave-type form with a space between the tarpaulin puller 106 and the flexible material 101 in which the vehicle 104 and rider 105 can go between. As the tarpaulin puller 106 moves, the wave form moves as well and resembles a wave breaking with a large tube, in which the rider travels.

The riders can either push themselves along or be pushed by the moving flexible material 101. As the tube travels, the rider travels as well usually finishing the ride by coming out of the tube.

While the foregoing describes a preferred embodiment of the present invention and an alternate embodiment, variation on this design and equivalent designs may be resorted to in the scope and spirit of the claimed invention.

What is claimed is:

1. A method of engaging in tarpaulin surfing, consisting of the steps of assembling a tarpaulin surfing apparatus, the apparatus comprised of a piece of flexible material, a handle, a plurality of weights, and a skateboard, the flexible material in a generally rectangular shape with a plurality of corners, the flexible material comprised of a material from the list of canvas, carpet, foam, vinyl, thin plastic, heavy cotton, nylon, and polyester, the flexible material possessing a coefficient of sliding friction sufficient to prevent said skateboard or any object from sliding across the flexible material, the flexible material designed to be rolled up into a compact cylindrical bundle when the apparatus is not being used, the handle connected removably to one corner of the flexible material, identifying a small group of players or participants, the group consisting of at least a rider and a tarpaulin puller, unrolling and laying the flexible material on a flat surface, placing the plurality of weights on the flexible material such that the flexible material is held down at two of the corners, placing the rider on his skateboard on the flexible material, having the tarpaulin puller grasp the handle attached to the flexible material and pull it up in the air, drawing the flexible material forward over the rider as the rider propels the skateboard across the flexible material.

* * * * *